United States Patent [19]

Bell

[11] Patent Number: 4,497,071

[45] Date of Patent: Feb. 5, 1985

[54] EXERCISE GARMENT

[75] Inventor: Richard S. Bell, Gloucester, Mass.

[73] Assignee: Mighty-Mac, Inc., Gloucester, Mass.

[21] Appl. No.: 350,321

[22] Filed: Feb. 18, 1982

[51] Int. Cl.[3] ..... A41D 1/00

[52] U.S. Cl. ..... 2/94

[58] Field of Search ..... 2/94, 69, 227, 85, 86, 2/247

[56] References Cited

U.S. PATENT DOCUMENTS

| | | | |
|---|---|---|---|
| 2,755,480 | 7/1956 | Jones | 2/94 |
| 2,762,054 | 9/1956 | Smith | 2/94 |
| 2,967,3 06 | 1/1961 | Fabanich | 2/94 |

*Primary Examiner*—Doris L. Troutman

*Attorney, Agent, or Firm*—Clarence A. O'Brien; Harvey B. Jacobson

[57] ABSTRACT

An exercise garment including a jacket and trousers in which the jacket is provided with a combined double entry side pocket and pouch having a zippered closure along the top edge thereof to enable insertion of an insulating member to protect a large portion of the abdomen and chest area with the double side entry pocket enabling easy access to a hand warmer or the like positioned therein. The trousers include a liner or undergarment provided with a crotch area lined with pile fabric, or the like, for comfort and warmth.

7 Claims, 6 Drawing Figures

10
12
14
16
18
20
22
24
26
28
30
32
34
36
38
40
42
44
46
48
50
52
54
56
58
60
62
64
66
68
70
72
74
86
88
90
2
6

EXERCISE GARMENT

BACKGROUND OF THE INVENTION

1. Field of the Invention

The present invention generally relates to an exercise garment for use when jogging, bicycling, sailing, skating, or other outdoor activities constructed of conventional fabric material, such as double knit, woven material or the like with the garment including a pullover type jacket and trousers with a resilient waist band. The jacket includes a unique double side entry pocket with a vertically opening pouch oriented in alignment therewith and outwardly thereof with the pouch including a zipper closure along the top edge thereof so that an insulating member, such as a folded newspaper or the like, can be inserted into the pouch for protecting the garment wearer from wind and the like in order to enable use of the jacket in adverse weather conditions. The trousers includes an inner liner in the form of a panty or shorts having a crotch portion that is pile lined for warmth and comfort.

2. Description of the Prior Art

Various types of exercise garments, jackets, trousers, and the like, are well known and the following U.S. patents disclose exemplary patents in this field of endeavor.

U.S. Pat. Nos. 139,950—June 17, 1873—J. Garaud
U.S. Pat. Nos. 1,851,294—Mar. 29, 1932—M. B. Rucker
U.S. Pat. Nos. 2,919,443—Jan. 5, 1960—J. Kashiyama
U.S. Pat. Nos. 3,046,563—July 31, 1962—G. J. Coleman
U.S. Pat. Nos. 4,031,568—June 28, 1977—B. Huff
U.S. Pat. Nos. 4,069,513—Jan. 24, 1978—P. Shiller, et al
U.S. Pat. Nos. 4,227,531—Oct. 14, 1980—S. McLeod.

SUMMARY OF THE INVENTION

An object of the present invention is to provide an exercise garment including a jacket having a double side entry pocket in the forward portion thereof, together with a pouch aligned with and disposed outwardly of the double side entry pocket, with a pouch having a zippered closure along the top edge thereof with the double side entry pocket enabling easy access to a hand warmer and the pouch adapted to receive an insulating member, such as a folded newspaper to protect a large portion of the abdomen and chest area from wind, and the like, thereby increasing the utility of the jacket.

Another object of the invention is to provide an exercise garment including trousers provided with a liner in the form of a panty or the like which has a crotch portion that is pile lined for warmth and comfort.

Yet another object of the invention is to provide an exercise garment constructed of conventional fabric material, such as double knit, woven material, or the like, adapted for outdoor use and which includes a top portion or jacket in the form of a pullover jacket and a lower portion or trousers that includes a resilient waistband and a structure for tightening the lower ends of the legs about the ankle area of the wearer.

Still another object of the invention is to provide an exercise garment which is relatively simple in construction, comfortable and warm for effectively protecting the wearer during various activities and which is relatively inexpensive to clean.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 6:
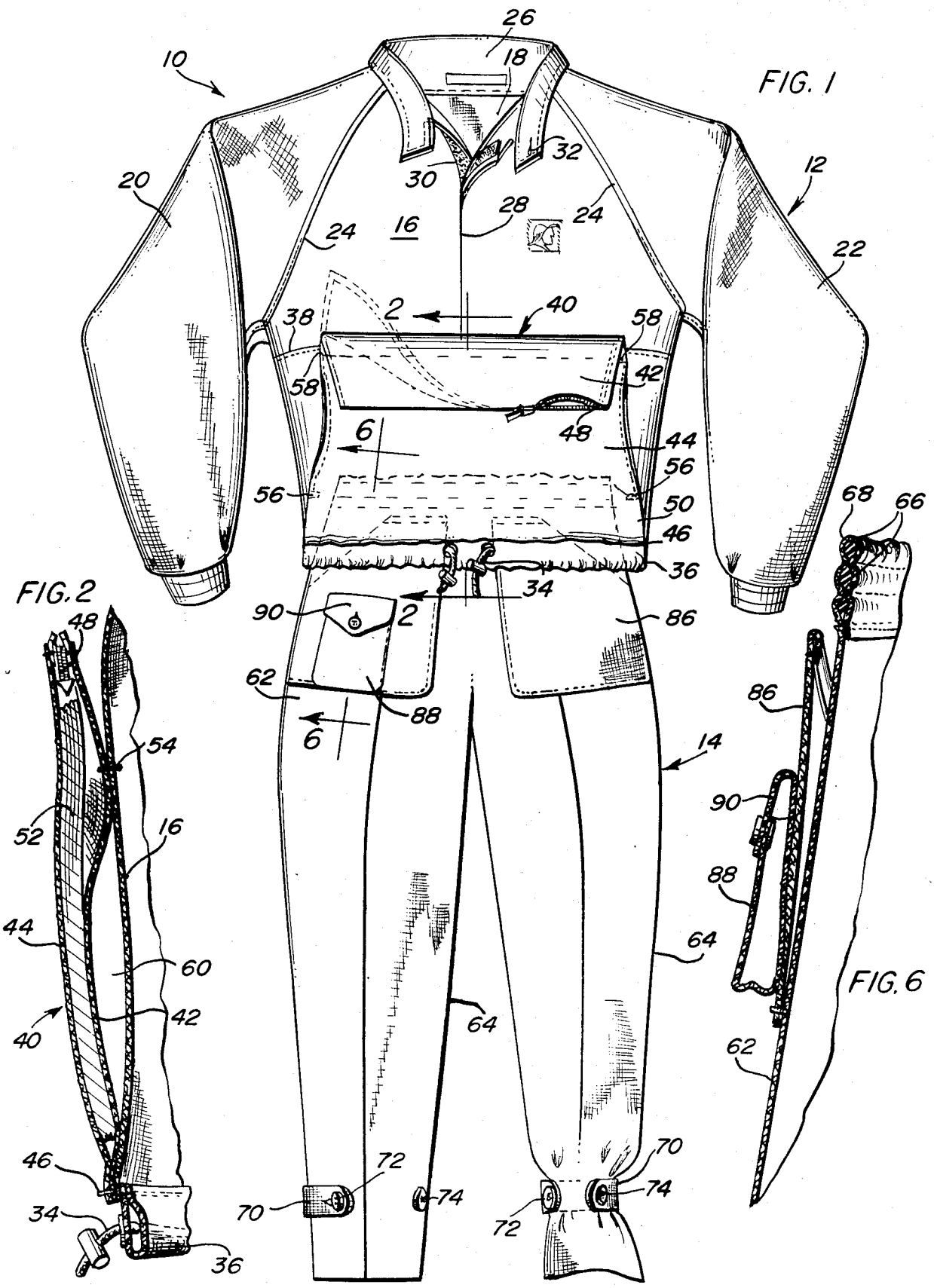
FIG. 1 is a front elevational view of the exercise garment of the present invention.
FIG. 2 is a sectional view taken substantially upon a plane passing along section line 2—2 of FIG. 1 illustrating the construction of the double side entry pocket and pouch.
FIG. 6 is a detailed sectional view taken along section line 6—6 of FIG. 1 illustrating the pocket structure on the trousers.
Figure 3:
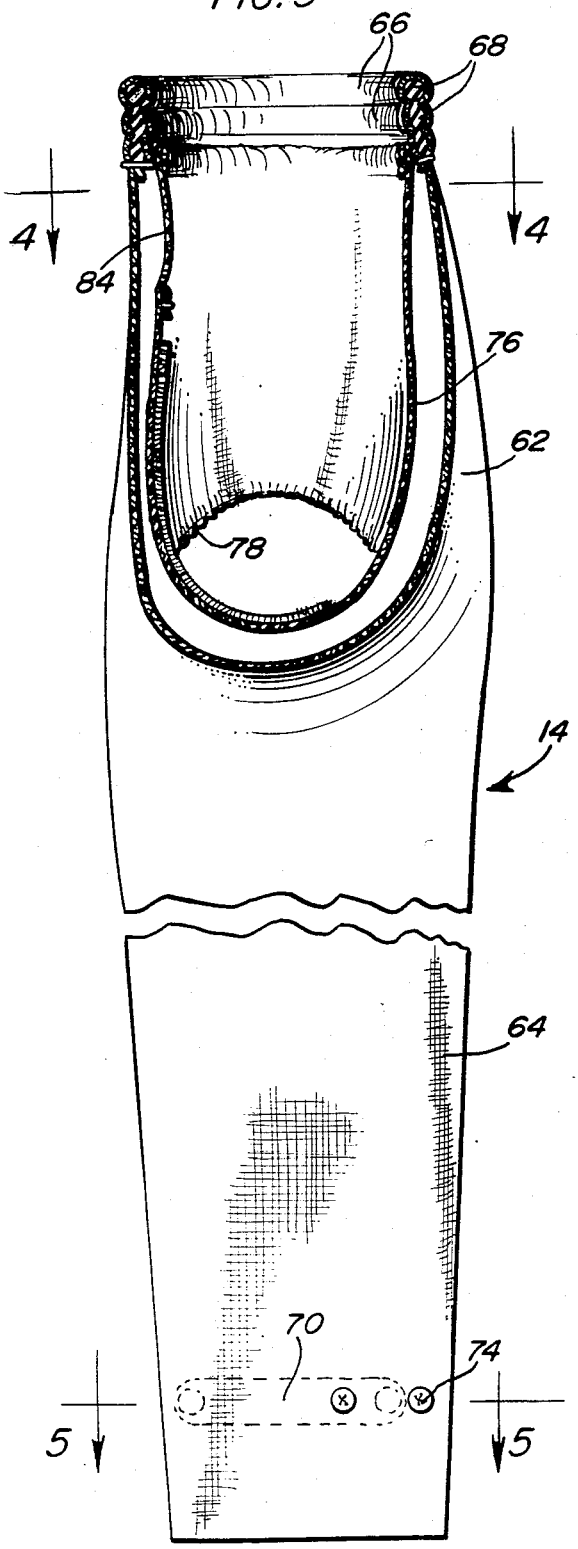
FIG. 3 is a vertical sectional view along the center of the trousers illustrating the panty-type liner and pile lined crotch portion.
Figure 4:
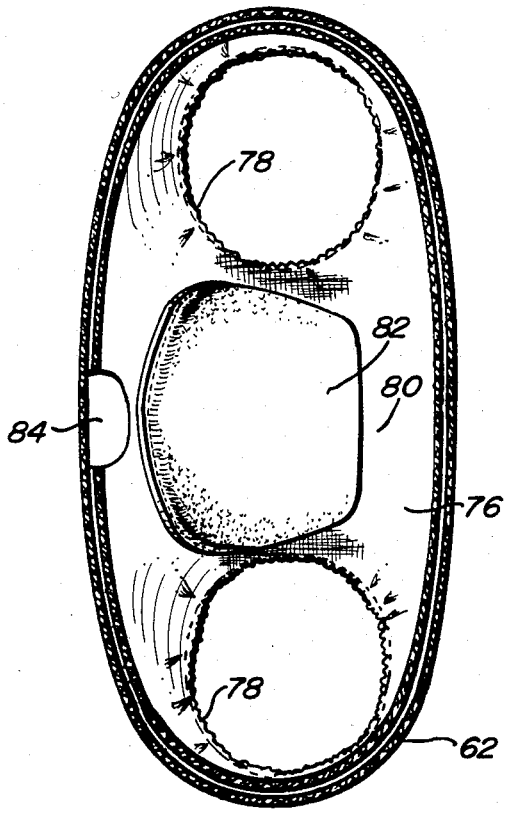
FIG. 4 is a sectional view taken substantially upon a plane passing along section line 4—4 of FIG. 3 illustrating further structural details of the trousers.
Figure 5:
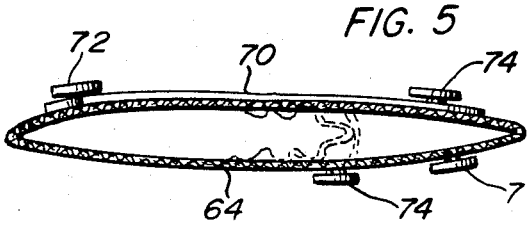
FIG. 5 is a transverse sectional view taken substantially upon a plane passing along section line 5—5 of FIG. 3 illustrating the structure for snugging the leg around the ankle portion of the wearer.

Referring now to the drawings, the garment 10 of the present invention is illustrated and includes a jacket 12 and trousers 14, both of which are constructed of conventional fabric material employed in constructing exercise garments, such as double knit, woven or similar material. The garment may be constructed in various colors and provided with any desired decorative components, such as leg stripes, sleeve stripes, multiple color structures, and the like.

The jacket 12 includes a front panel 16 and a rear panel 18 joined together along side seams to provide a garment which is continuous around the torso of the wearer. The jacket includes raglan sleeves 20 and 22 which are connected to the panels 16 and 18 by inclined seams 24 in a conventional manner with the seams 24 extending from a juncture with the side seams at the underarm portion to the neckline of a collar 26. This structure is conventional in and of itself and the front panel 16 is provided with a vertical opening 28 to enable the jacket to be more easily donned with suitable fastening arrangements, such as "Velcro", 30 being used to detachably secure the opening 28 in closed relation. The collar 26 may have extensions 32 disposed in overlapping and secured relation when the garment is worn with a button and buttonhole arrangement, snap fastener arrangement, "Velcro" or the like being utilized to secure the overlapping extensions 32 on the collar 26 together. The lower end of the jacket 12 is provided with a drawstring 34 oriented in a hem 36 in a conventional manner with the drawstring extending out through openings in the hem at the lower center of the front panel 16 and provided with knots so that the drawstring can be used to snug the lower end of the jacket around the wearer in a well known manner.

As illustrated, the front panel 16 is constructed of two panels with a transverse seam 38 connecting the two panels and attached to the front panel 16 is a pouch 40 which consists of an inner panel 42 and an outer panel 44 of the same material as the jacket itself. The bottom edges of the panels 42 and 44 are secured together and secured to the front panel 16 by stitching 46 and the top edges of the panels 42 and 44 are provided with a zipper closure 48. The side edges of the panels 42 and 44 are also secured together by stitching 50 to provide a closed pouch with access to the interior thereof being through the zipper closure 48 with the size of the pouch 40 being such that a folded newspaper 52 may be placed therein for insulation purposes or a similar insert of insulating material or wind impenetrable material may be inserted therein. The inner panel 42 of the pouch is secured to the front panel 16 by transverse stitching 54 that is spaced downwardly from the upper edge of the inner panel 42 as illusrated in FIG. 2. The lower side edge portions of the pouch are secured to the front panel 16 by the stitching 50 which also secure the inner and outer panels together up to a bar tack or seam 56 so that the stitched together side edges of the pouch above the bar seams 56 are free of the front panel 16 up to the line of stitching 54 which also includes a bar tack or seam 58 at the outer ends thereof, thus forming a double side entry pocket 60 between the inner panel 42 and the front panel 16. This type of pocket is a muff-type pocket and provides easy access to a hand warmer or the like which may be positioned in the pocket 60. Even with a newspaper or other insert in the pouch 40, access can still be gained to the interior of the pocket 60 by inserting either or both hands into the side entries between the bar seams 56 and 58. Thus, with this construction, the jacket provides warmth and comfort during various outdoor activities and not only provides easy access to the pockets through either or both side entries, but also provides a pouch for securely placing various articles to prevent loss and also to receive an insulating member, such as the newspaper 52, or the like. Further, the drawstring 34 may be resilient and stretchable to facilitate movement of the bottom edge of the jacket in relation to the wearer which is desirable when performing various activities. Also, the sleeves 20 and 22 may be provided with a resilient cuff or the like, if desired, or other means may be provided to snug the cuff on the sleeve around the wrist area of the wearer and means may be provided on the sleeves to tether gloves thereto or, if desired, means may be provided for connecting gloves to the cuffs.

The trousers 14 include a waist and lower torso enclosing body portion 62 having depending legs 64 integral therewith with a multiple waistband hem arrangement 66 being provided at the upper edge thereof for receiving elastic members 68. to retain the trousers in position. The trousers may be constructed of the same material as the jacket and the waist encircling hems 66 and body portion 62 may be conventionally constructed and the legs are also conventional, except that a snugging strap 70 is attached to the leg adjacent the lower ends thereof with a button or other fastener 72 being provided for this purpose. The other end of the strap is selective engaged with one of a series of circumferentially spaced buttons 74 in order to snug the leg around the ankle area of the wearer. Other fastening means may be provided, such as snap fasteners, "Velcro", or the like, to retain the snugging strap 70 in adjusted position as illustrated in FIG. 1 to further enhance the protective characteristics of the trousers.

The body portion 62 of the trousers is provided with a panty-type liner 76 secured to the lowermost hem 66 at its upper edge with the panty liner 76 including leg openings 78 and a crotch area 80 therebetween. A substantial portion of the crotch area and the area immediately in front of and above the crotch area is provided with a lining of pile fabric 82 on the interior surface thereof to provide additional warmth and comfort to portions of the anatomy of the wearer which is engaged by the pile lining. The forward upward end portion of the panty liner 76 is provided with a recess or notch 84 of U-shaped configuration to enable variation in the size of the upper end of the liner as the garment is pulled over the larger hip area of a wearer when donning or removing the trousers. Also, the trousers are provided with exterior pockets at each side of the front thereof which may be in the form of slash-type patch pockets 86 and on the exterior of one of the pockets 86, a smaller separate patch pocket 88 is provided having a button secured flap 90 provided thereon to provide adequate pocket area for receiving various items desired to be effectively and securely carried by a person using the garment.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A garment comprising a jacket including a front panel, a combined vertically opening pouch and double side entry pocket secured to said front panel, said combined pouch and pocket including inner and outer panels secured peripherally together except for top edge portions, zipper closure means extending along the top edge portions of the inner and outer panels to provide access to the interior of the pouch, means securing the bottom edge portion of the pouch to the front panel and means securing the inner panel to the front panel of the jacket in vertically spaced relation to the bottom portion of the pouch with the side edges of the pouch being free of the front panel thereby providing a pair of side entrances into a pocket defined by the front panel of the jacket and the inner panel of the pouch.

2. The structure as defined in claim 1 wherein means secures the lower side edge portions of the pouch to the front panel of the jacket to provide means to retain items in the pocket such as a hand warmer with the side entrances enabling both hands to gain easy access to the interior of the pocket.

3. The structure as defined in claim 2 wherein the means securing the inner panel to the front panel of the jacket includes a line of stitching spaced vertically downwardly from the zipper closure means, said inner and outer panels being constructed of flexible fabric material to enable the upper end portion of the pouch to fold downwardly along the line stitching.

4. The structure as defined in claim 3 wherein said inner and outer panels are coextensive and cover a substantial portion of the abdomen and chest region of a wearer and being adapted to receive an inserted insulating member such as a folded newspaper to protect a substantial portion of the abdomen and chest region from wind, thereby enabling the jacket to be effectively used when performing outdoor activities.

5. The structure as defined in claim 4 wherein said jacket includes shoulder portions, a neck opening and sleeves, together with a vertical entrance area communicated with the neck opening and provided with closure means to close the vertical opening and neck opening, said jacket also including a back panel and a rear panel with the back and rear panels being integral at the lower portion of the jacket thereby providing a pull-over type jacket.

6. The structure as defined in claim 1 together with trousers used in combination with the jacket, said trousers including a body portion and depending legs for enclosing a person from the waist region to the ankle region, a panty liner for the body portion, said panty liner including an area lined with pile fabric to increase the warmth and comfort of the trousers.

7. The structure as defined in claim 6 wherein the body portion of the trousers includes multiple hems and resilient inserts at the waist region and means at the lower ends of the legs to snug the legs around the ankle region of the wearer.

* * * * *